US005375618A

United States Patent [19]

Giannesini

[11] Patent Number: 5,375,618

[45] Date of Patent: Dec. 27, 1994

[54] MULTIPHASE FLUID REGULATING AND DISTRIBUTING DEVICE

[75] Inventor: Jean-François Giannesini, Saint Cloud, France

[73] Assignee: Institut Francais du Petrole, Rueil Malmaison, France

[21] Appl. No.: 104,580

[22] Filed: Aug. 11, 1993

[30] Foreign Application Priority Data

Aug. 11, 1992 [FR] France ..... 92 09989

[51] Int. Cl.[5] ..... G05D 11/02

[52] U.S. Cl. ..... 137/110; 137/171; 137/567; 137/590

[58] Field of Search ..... 137/110, 154, 171, 567, 137/590, 599

[56] References Cited

U.S. PATENT DOCUMENTS

| | | | |
|---|---|---|---|
| 4,516,986 | 5/1985 | Jepsen | 137/110 |
| 4,574,827 | 3/1986 | Konak | 137/599 X |
| 4,641,679 | 2/1987 | Arnaudeau et al. | 137/110 X |
| 4,681,129 | 7/1987 | Juzi et al. | 137/154 |

FOREIGN PATENT DOCUMENTS

| | | |
|---|---|---|
| 2731279 | 7/1977 | Germany . |
| 8810901 | 12/1988 | Germany . |
| 90/08585 | 8/1990 | WIPO . |

OTHER PUBLICATIONS

Patent Abstracts of Japan, vol. 5, No. 47, Mar. 28, 1981.

Patent Abstracts of Japan, vol. 15, No. 279, Jul. 16, 1991.

Patent Abstracts of Japan, vol. 6, No. 142, Jul. 31, 1992.

*Primary Examiner*—Stephen M. Hepperle

[57] ABSTRACT

Device for supplying a multiphase fluid comprising at least a liquid phase and a gas phase to a pumping assembly. The device consists of a tank including means for taking samples of the fluid, at least two, extending in the tank so as to run across the liquid-gas interface under normal working conditions, said sampling means comprise sample openings distributed on either side of said interface under normal working conditions, the sampling means being connected to the pumping assembly.

9 Claims, 3 Drawing Sheets

MULTIPHASE FLUID REGULATING AND DISTRIBUTING DEVICE

FIELD OF THE INVENTION

The present invention relates to a device for supplying a multiphase fluid to a pumping assembly located downstream from the device.

The invention is particularly suited to the distribution of several multiphase fluids, each multiphase fluid comprising a liquid phase and a gas phase of a given GLR value. The GLR value is defined hereafter as the ratio of the gas phase of a multiphase fluid to the liquid phase.

BACKGROUND OF THE INVENTION

The conveyance of fluids or effluents of the multiphase type without separation of their constituents is very important in industry since it avoids separation of the phases of the effluent and recompression or pumping of each of the phases separately.

However, this method of conveyance without separation of the effluents requires the use of pumps capable of communicating to the effluents a sufficient pressure value to ensure their transfer over a certain distance.

Most pumps, if not all of them, are adapted to transfer effluents having a certain GLR value included in a determined range. In order to overcome this limitation, a device for regulating the fluctuations of effluents is positioned upstream from the pump and allows the latter to be supplied with an effluent whose GLR value is compatible with the working characteristics of the pump.

French patent No. 2,642,539 thus describes a device allowing damping and regulation of the sudden variations of liquid and gas running into the device, notably on the appearance of gas or liquid plugs, i.e. a large amount of fluid consisting of the gas phase or of the liquid phase only, and enabling the pump positioned thereafter to be supplied with an effluent having a given GLR value.

French patent application 91/16,231 also mentions a method for predimensioning a device of the type described in French patent FR-2,642,539 in order to have, at any time, a sufficient amount of liquid to carry off a large amount of gas and to maintain an optimum GLR value according to the characteristics of the multiphase pump located downstream.

It is however becoming increasingly important to have a device allowing transmission, to a pumping assembly consisting of at least two pumps, a multiphase fluid whose GLR value is compatible with the running of each of the pumps. In fact, the transfer of a multiphase fluid of a large volume may require the use of several pumps, each pump having its own characteristics.

Moreover, increasingly compact and lighter units are much sought-after for economic reasons and in order to allow production in difficult zones.

Finally, it is necessary to have devices of simple and reliable design.

SUMMARY OF THE INVENTION

The present invention relates to a device for supplying a multiphase fluid, the fluid consisting of at least a liquid phase and a gas phase, to a pumping assembly communicating a compression value to the fluid, the device comprising a phase separating tank, the tank including at least one multiphase fluid feed opening and means for taking the content of the tank. The device according to the invention comprises at least two sample tubes extending in the tank so as to run across the interface between the phases under normal working conditions, the sample tubes comprising sample ports, the ports being distributed on at least part of the length of the sampling means so as to have, at the outlet of at least one of the sample tubes, a predetermined GLR value and the tubes are connected to the pumping assembly.

Each sample tube may comprise at least one common outlet for the liquid phase and the gas phase.

The device may comprise means for orienting the multiphase fluid coming from an outlet of a sample tube, such as a manifold.

The device may comprise means for measuring characteristic parameters of the source of effluents and of the effluent, and signal processing and generating means (8) delivering control signals towards the orienting means according to the measured parameter values.

The device may comprise measuring means including at least one flowmeter allowing the flow of fluid at the outlet of the sample tubes to be obtained.

The measuring means may include at least one means for measuring the GLR value of the effluent.

The pumping assembly may comprise at least one multiphase pump, the distribution of the ports on a sample tube being selected according to the pump associated with the tube.

The number of sample tubes may he selected so as to favour the discharge of a gas phase of large amount.

One object of invention is to provide a device supplying a multiphase fluid coming from a source of effluents having a controlled GLR value to a pumping assembly including several multiphase pumps having each its own working characteristics.

Another advantage of the device consists in adapting the number of pumps used to the real flow rate of the multiphase fluid coming from a source of effluents.

BRIEF DESCRIPTION OF THE DRAWINGS

Other features and advantages of the device according to the invention will be clear from reading the description hereafter given by way of non limitative examples, with reference to the accompanying drawings in which.

DESCRIPTION OF THE PREFERRED EMBODIMENTS

The device described hereafter allows dividing of a multiphase fluid such as a petroleum effluent, consisting of a gas phase and of a liquid phase, into several multiphase flows or subeffluents, referred to as secondary flows hereafter, whose GLR value is controlled, and orientation of these secondary flows towards at least one of the multiphase pumps of a pumping assembly.

This result is obtained by using a tank or regulating drum equipped with several tubes pierced with ports, the distribution of these ports being selected according to the pumping characteristics of the pump associated with this tube.

Figure 1:
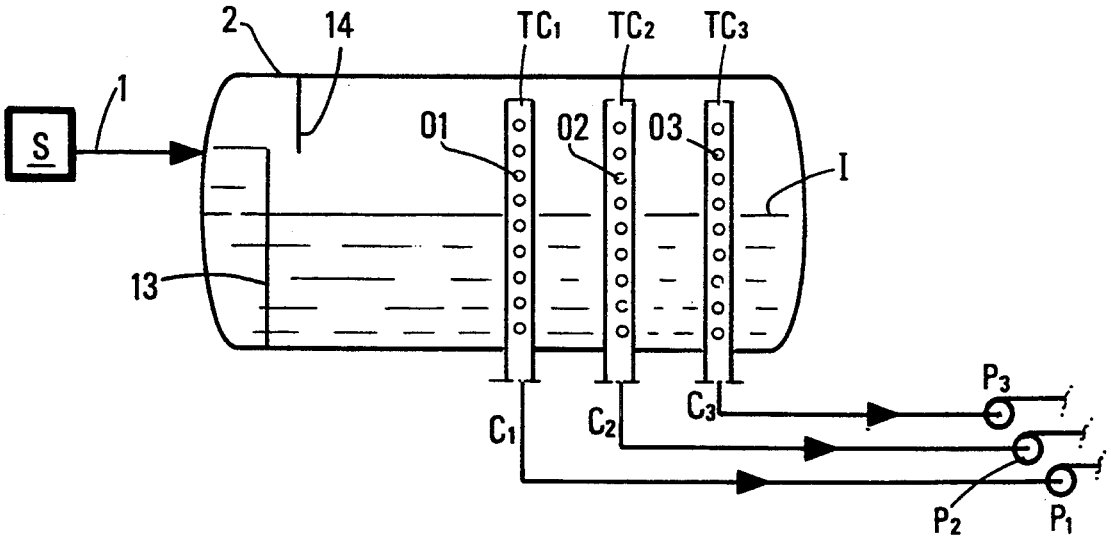
FIG. 1 shows a tank equipped with three tubes pierced with ports.

The multiphase fluid is conveyed from a source of effluents S into a device including a tank 2 equipped with several sample tubes, by means of a pipe 1 or supply pipe. The device is provided, for example in FIG. 1, with three sample tubes TC1, TC2, TC3. These sample tubes TC1, TC2, TC3 are respectively provided with sample ports O1, O2, O3 which are distributed by zones over at least part of the length of each of the tubes. The distribution of these ports, i.e. their dispatching and their geometric characteristics, is selected so as to obtain a predetermined GLR value at the tube outlet.

Each sample tube TC1, TC2, TC3 is connected to an escape pipe, respectively C1, C2, C3 for discharging the effluent towards at least one pump P1, P2, P3 of a pumping assembly.

Reference I diagrammatically shows the liquid-gas interface.

It is advantageous to have, at the inlet of the tank, a system such as baffles 13, 14 preventing too high a disturbance at the level of the liquid-gas interface I upon too sudden an inflow of fluid in tank 2. The use of these baffles is also advantageous in that a substantially constant interface level I may be obtained in the whole of the tank.

The sample ports may be distributed in various ways. They may for example be distributed as described in French patent 2,642,539.

When adequacy is desired between the GLR value of part of the effluent at the outlet of a sample tube and the value corresponding to the best working characteristics of a pump located downstream from this tube, it is possible to use, for example to determine the distribution of the ports, the method described in French patent application 91/16,231. The distribution of the ports along a tube, for example TC1, is such that the GLR value obtained at the outlet of this tube corresponds to the working characteristics of the pump connected thereto, for example P1 in the figure. One main characteristic of the pump to be respected is the GLR value tolerated by the pump at its inlet or intake and which enables the pump to communicate to the effluent a sufficient pressure value to ensure the transfer thereof. In this case, adequacy is obtained by adapting the GLR value of the effluent reaching the level of a pump to the GLR value tolerated by the pump at the inlet thereof.

The invention thus allows distribution of an effluent divided into several subeffluents with GLR values adapted to several pumps working in parallel and having each its own pumping characteristics, by associating a sample tube with a pump according to the GLR values of the effluent at the outlet of the tube and to the pump working GLR value.

One possible application of the device according to the invention consists in selecting the number of pumps necessary to the transfer of the fluid entering the tank, according to the real flow rate of the effluent source. In fact, the production of effluent during the life of a well being variable, it is advantageous to adapt the number of pumps used for transferring the effluent to the real rate of the well, at any time. To that effect, it is essential to know at any time the value of the flow rate of the effluent source, which may be obtained in various ways, some of them being described hereafter.

Figure 2:
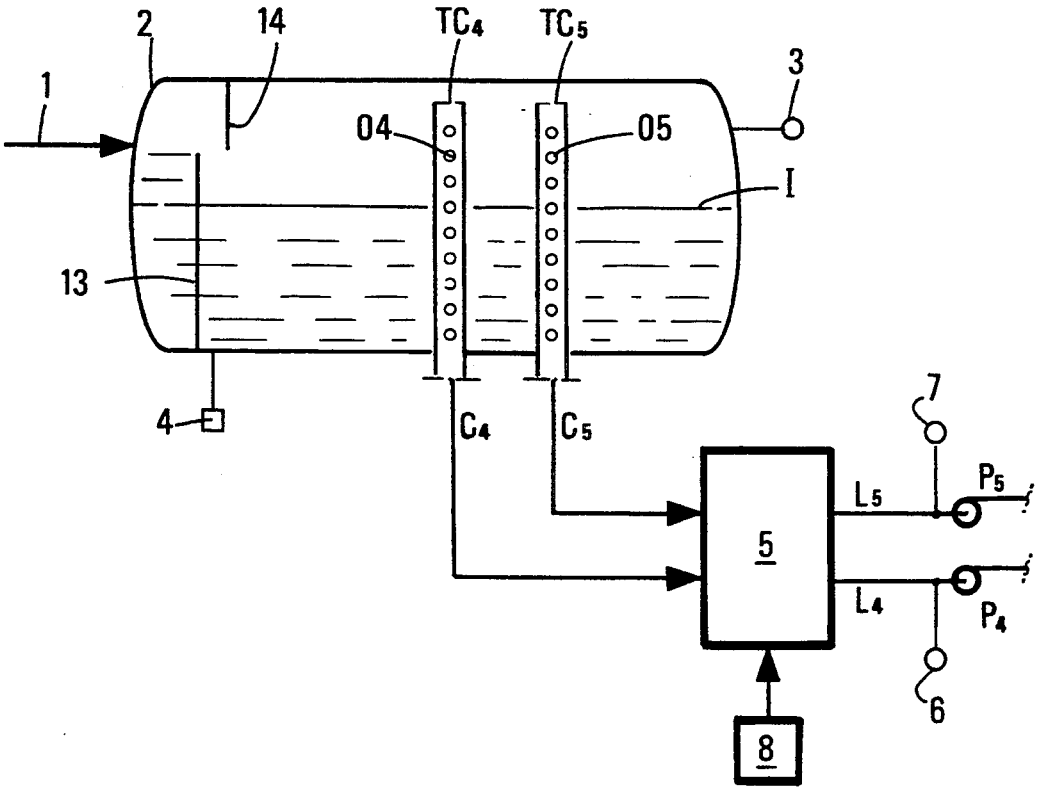
FIG. 2 shows an example of an embodiment of the device according to the invention comprising a manifold and means for calculating the flow rate of the fluid.

FIG. 2 shows an embodiment of the device according to the invention equipped with a device for calculating the flow rate of the effluent source S. The tank 2 comprises two sample tubes TC4, TC5 provided respectively with ports O4, O5; it is equipped with measuring means such as a pressure sensor 3 and a level detector 4. These tubes run across the gas-liquid interface I under normal working conditions; they may be vertical and run right through tank 2. They are connected to a manifold 5 by pipes C4, C5, the manifold being connected to a pumping assembly, comprising in this example two pumps P4, P5, by transfer pipes L4, L5. Means for measuring the pressure of the effluent, such as pressure sensors 6, 7, are positioned at the inlet of each pump P4, P5 delivering the pressure value of the effluent measured at the pump intake. The various measuring means 3, 4, 6 and 7 are connected through electric links to a processing and control device 8 such as a programmable processor. The data coming from these various measuring means are sent to processor 8 which calculates the GLR value associated with a sample tube and, permanently, the value of the flow rate of the effluent passing through each sample tube TC1, TC2. According to the values calculated, processor 8 sends a control signal regulating the opening and/or the closing of the manifold valves so as to distribute the effluent towards one or several pumps. The processor is thus connected to manifold 5 through an electric link allowing for example the signals necessary for controlling the valves to be transmitted.

Operation of such a device may for example be achieved as follows: the value of the flow rate of the effluent source is known at any time through measurements known by specialists. With this value, the value of the GLR relative to a sample tube determined, for example, by using the method described in patent application FR-91/16,231, with the pressure values measured at the inlet of a pump, processor 8 calculates the respective amounts of gas and liquid flowing through each sample tube and deduces therefrom the value of the flow rate Qi of the effluent passing through a sample tube. The value of the overall effluent flow rate flowing through the various sample tubes is obtained by summing the various amounts determined previously. Processor 8 compares this new value to a threshold value.

If the new value is less than the threshold value, the processor acts in various ways, two preferred ways being described hereunder, these embodiments being not restrictive.

1) If the GLR values determined previously are close to each other, the microprocessor sends:

a control signal controlling the opening or the closing of the manifold valves so that the effluents coming from the various sample tubes and passing through pipes C4, C5 are distributed towards one of pipes L4, L5 ending at the pumping assembly, and a control signal starting only the pump in which end all the effluents coming from the various sample tubes.

The number of pumps working is thereby adapted to the amount of effluents coming from the source or real flow rate of the effluent source.

2) If the GLR values are different from one another, the microprocessor calculates the average GLR value associated with the various sample tubes. It compares this value to the GLR values associated with the pumps included in the pumping assembly and directs the whole of the effluents towards the pump with the closest GLR value. To that effect, the microprocessor sends a control signal towards the manifold valve which communicates the pump whose GLR value is the closest to the determined average GLR value.

Figure 3:
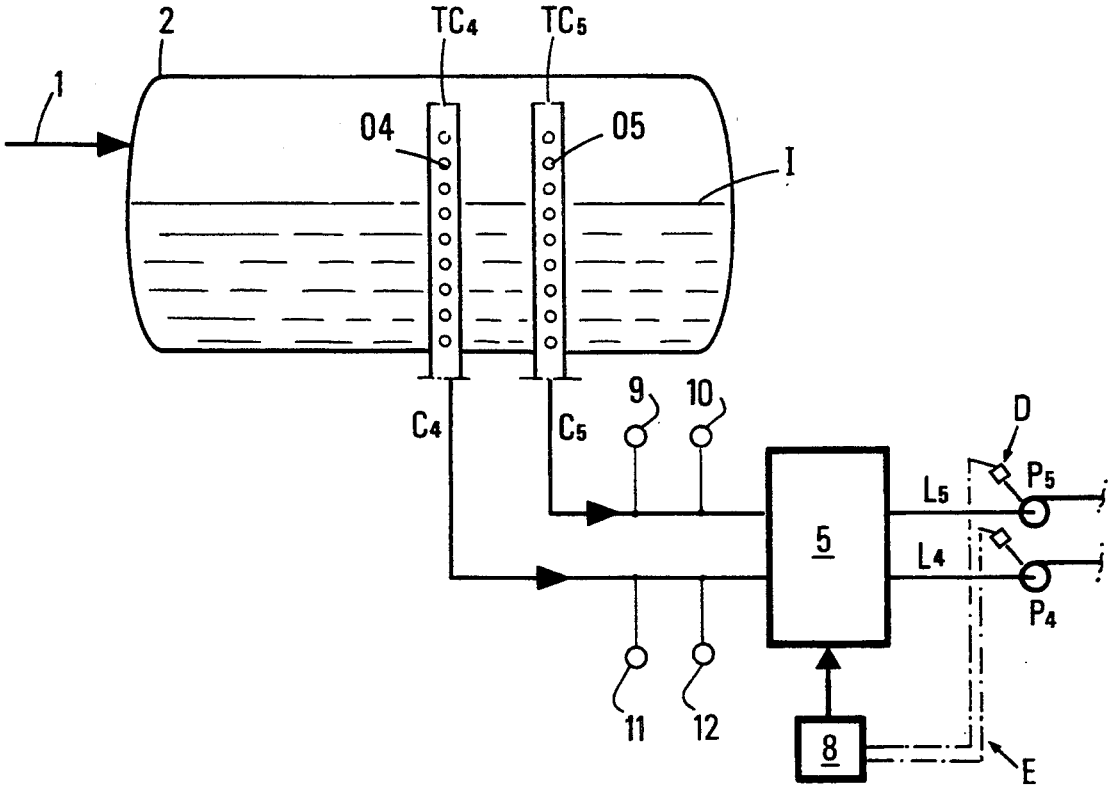
FIG. 3 shows a variant of the embodiment of the device of FIG. 2 for which the calculating means are replaced by measuring means.

In the embodiment of FIG. 3, each transfer pipe C4, C5 for transferring the effluent is provided with means 10, 12 for measuring the flow rate of the effluent and with means 9, 11 for determining the value of the GLR parameter of the effluent at the inlet of a pump.

The running of such a device differs from that described in connection with FIG. 2 in the way the flow rate of the effluent for each sample tube and its GLR value are obtained. In this embodiment, the GLR value and the value of the flow rate of each of the subeffluents are measured by means of the appropriate devices 9, 11 and 10, 12.

Control of the distribution of the subeffluents and of the starting of the pumps necessary to the transfer of the assembly is identical to that described in FIG. 2.

A device such as that described in French patent FR-2,647,549 cited above is for example used to measure the GLR value.

The data coming from the various measuring means are sent to processor 8 which processes them as described above.

The device of FIG. 2 may be adapted to detect and to react when a pump breaks down.

It comprises in this case, in addition to the elements described in FIG. 2, a device D for detecting the failure of a pump. This device D is connected to the processor by a conventional electric link. It shows processor 8 the working condition of the pump to which it is connected and sends an alarm signal to the processor in case of a failure of the pump. Processor 8 then identifies the laid-up pump, its number and the GLR value associated therewith. It compares this GLR value to the various values associated with the pumps constituting the pumping assembly. After comparing the GLR value corresponding to the laid-up pump with the other values, processor 8 sends a control signal to the manifold valves so as to redirect the amount of effluent flowing towards the laid-up pump towards another or other pumps of the pumping assembly, according to the effluent amount, whose GLR characteristics are the closest to those of the laid-up pump.

The number of pumps concerned or required to absorb the amount of effluent coming from the laid-up pump depends on this amount and on the amount of effluent which can be absorbed by the pumps prompted by the processor. Knowing at any time the amount of effluent flowing through a tube pierced with ports and the amount of effluent to be distributed at the level of the various pumps, processor 8, by means of a difference calculation, directs the amount of effluent coming from the laid-up pump towards the other pumps, by sending an opening signal to the valve corresponding to the pump whose GLR value is the closest to that of the defective pump. As soon as the maximum amount of effluent which the pump concerned may accept in addition has been diverted by the processor, the latter urges the pump with the next GLR value closest to the laid-up pump and controls the valve allowing part of the rest of the effluent coming from the laid-up pump to be diverted towards the second urged pump. The processor proceeds this way until all of the subeffluent to be redistributed or at least until the largest possible part has been dispatched towards the various pumps.

More generally, the present invention allows a good adaptation between the real flow rate of effluent coming from the source and the pumping means, through the use of several perforated sample tubes placed in a tank or regulating drum.

Figure 4:
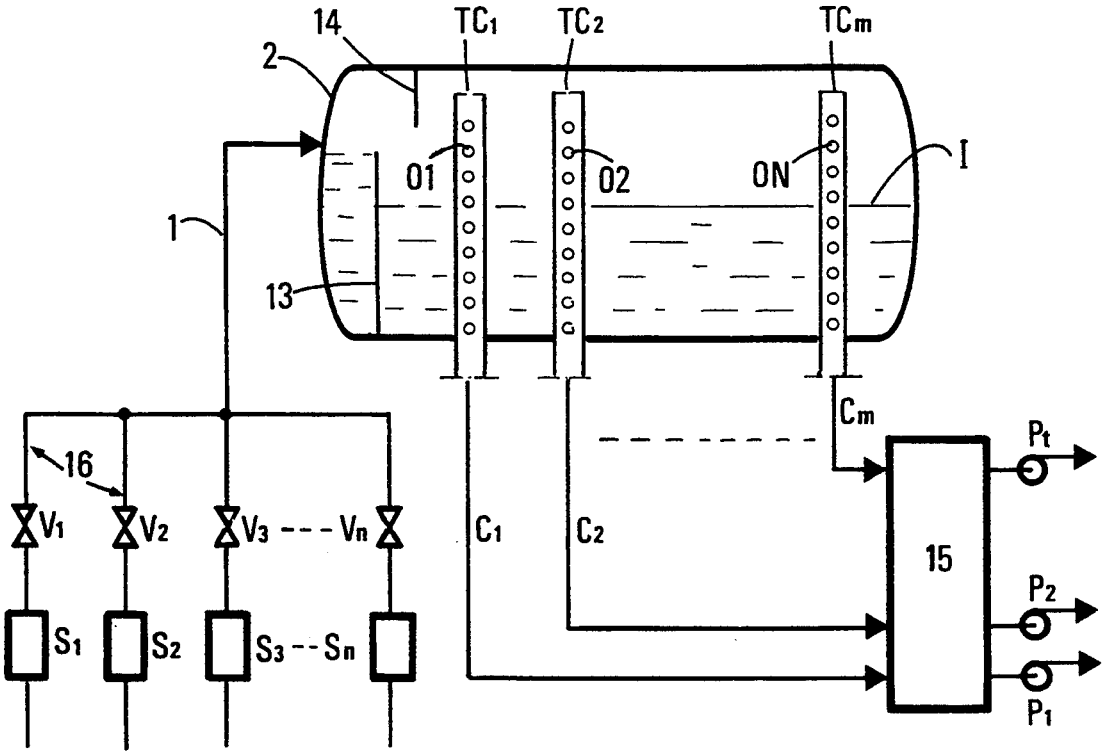
FIG. 4 shows the use of the device according to the invention for a set of sources of effluents.

FIG. 4 is another example of the application of a device according to the invention, comprising several sources of fluid, such as oil wells S1, S2, . . . Sn connected through lines 16 to tank 2 by means of pipe 1. The effective passage of the effluent coming from a source S1, S2, . . . Sn towards the tank or regulating drum 2 is for example controlled by a valve, respectively V1, V2, . . . Vn. This valve is of a conventional valve type commonly used in the petroleum field and may be remote controlled by means of control lines well-known by specialists.

The regulating drum 2 (FIG. 4) comprises several sample tubes TC1, TC2, . . . TCn connected to a distribution assembly 15 controlling the supply or distribution of the effluent towards hydraulic pumps P1, P2, . . . Pt. This system allows pumps P1 to Pt to be supplied according to various modes some examples of which will be described hereafter.

Figure 5:
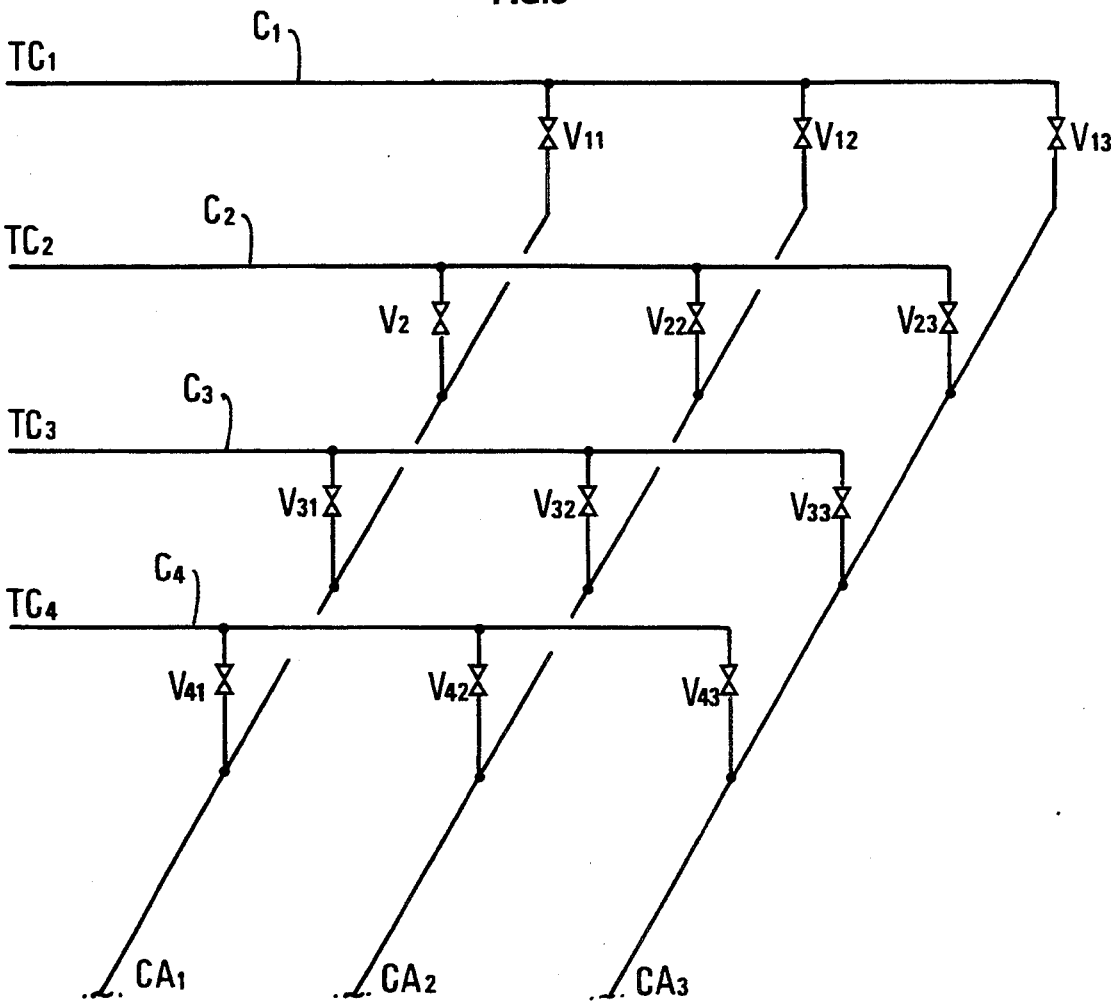
FIG. 5 shows in a more detailed way a distribution system of the effluents coming from sample tubes.

Thus, FIG. 5 diagrammatically shows an example of a system for distributing the effluent in which each tube TC1, TC2, TC3, TC4 is connected to a line C1, C2, C3, C4, and the inlet or intake of a pump P1, P2, P3, P4, not shown in the figure for reasons of simplification, is connected to a line CA1, CA2, CA3. The number of lines Ci may be different from the number of lines CAi.

Each line Ci, $i=1,4$ is connected to a line CAj, $j=1,3$ by a valve Vij.

Such a device may work as follows: valves Vii being open and the other valves closed, the effluent from a source Si flows through line Ci, then into tube TCi and is thereafter distributed to pump Pi by means of pipe CAi. In this example, a sample tube TCi allows passage of the effluent only towards a pump Pi. By opening valves V41, V42 and V43, the effluent from sample tube TC4 is allowed to pass towards pumps P1, P2, P3 which are then respectively supplied by tubes TC1, TC4; TC2, TC4; and TC3, TC4.

Valves Vij are for example remote controlled and piloted by means of processor 8, in order to optimize the operation of the assembly consisting of the various sources of effluents and of the pumps located downstream from the tank. This optimization may for example consist in selecting the number of pumps according to the real flow rate of the sources of effluents, as described previously.

Optimization may also consist in obtaining a nearly total adequacy between the value of the effluent flowing out of a sample tube and a pump located downstream from the tube.

Without departing from the scope of the present invention, a pump may be supplied by two sample tubes. In fact, such a device may be beneficial when the physical characteristics of the well, such as pressure and rate of flow, vary in time.

If the surge drum has three vertical sample tubes, they may be aligned or placed at the vertices of a triangle.

Of course, the process and the device which have been described by way of non limitative examples may be provided with various modifications and/or additions by the man skilled in the art without departing from the scope of the invention.

I claim:

1. A device for supplying a multiphase fluid to a pumping assembly, said fluid comprising at least a liquid phase and a gas phase and said pumping assembly providing a compression value to said fluid, said device comprising a tank for separating phases of said multiphase fluid, said tank comprising at least one multiphase fluid feed inlet, and means for discharging the contents of fluid from the tank, said discharge means comprising at least two sample tubes positioned in said tank to extend across an interface between said gas and liquid phases under normal working conditions, each of said sample tubes including sample ports, said ports being distributed on at least part of the length of each of said sample tube to provide at an outlet of each of the sample tubes a subflow of the fluid having a predetermined GLR value, and a distribution assembly connecting the outlets of said at least two sample tubes to at least two pumps of said pumping assembly; said distribution assembly directing the subflows of predetermined GLR values to pumps exhibiting pump conditions appropriate for said predetermined GLR values.

2. A device as claimed in claim 1, wherein each sample tube comprises at least one common outlet for the liquid phase and the gas phase.

3. A device as claimed in claim 1, further comprising means for measuring parameters of a fluid flow and a signal processing and generating means for delivering control signals to the distribution assembly according to the measured parameter values, said measuring means being positioned in at least one of the following locations: inlet pipes of the distribution assembly, outlet pipes of the distribution assembly and the feed inlet to the tank.

4. A device as claimed in claim 3, wherein the measuring means comprises at least one flowmeter allowing the flow rate of fluid at an outlet of each of the sample tubes to be determined.

5. A device as claimed in claim 3, wherein the measuring means includes at least one means for measuring the GLR value of the fluid at one of said locations.

6. A device as claimed in claim 1, wherein the at least two sample tubes provide subflows that exhibit different GLR values, the pumping assembly comprising at least two multiphase pumps, each exhibiting a different pumping condition or characeristic and each pump being adapted to operate with only one of said different GLR values.

7. A device as claimed in claim 1 or claim 3, wherein the distribution assembly is remotely controlled.

8. A device as claimed in claim 7, wherein said distribution assembly is remotely controlled by processing means which automatically controls the distribution assembly in relationship with the measured parameters obtained by said measuring means.

9. A device as claimed in claim 3, wherein the measuring means comprises a detecting device for determining failure of said at least two pumps of said pumping assembly.

* * * * *